US007152441B2

(12) United States Patent
Friar et al.

(10) Patent No.: US 7,152,441 B2
(45) Date of Patent: Dec. 26, 2006

(54) CART LOCKING DEVICE

(75) Inventors: Timothy A. Friar, Sunbury, OH (US); Ryan Scott Crisp, Lewis Center, OH (US); George Clark, Lewis Center, OH (US)

(73) Assignee: Artromick International, Inc., Columbus, OH (US)

( * ) Notice: Subject to any disclaimer, the term of this patent is extended or adjusted under 35 U.S.C. 154(b) by 151 days.

(21) Appl. No.: 10/798,634

(22) Filed: Mar. 11, 2004

(65) Prior Publication Data

US 2005/0199022 A1 Sep. 15, 2005

(51) Int. Cl.
*E05B 65/44* (2006.01)

(52) U.S. Cl. ..... 70/78; 70/279.1; 70/284; 70/86

(58) Field of Classification Search ..... 70/78–88, 70/279.1–282, 284, 285; 312/221
See application file for complete search history.

(56) References Cited

U.S. PATENT DOCUMENTS

| | | | | |
|---|---|---|---|---|
| 1,265,054 | A | | 5/1918 | Clauson |
| 2,873,159 | A | * | 2/1959 | Becker ..... 312/319.7 |
| 4,341,155 | A | | 7/1982 | Relyea et al. |
| 4,813,753 | A | | 3/1989 | Relyea |
| 4,822,116 | A | | 4/1989 | Relyea et al. |
| 4,895,008 | A | * | 1/1990 | Blake ..... 70/86 |
| 4,958,891 | A | | 9/1990 | Taylor et al. |
| 5,139,321 | A | | 8/1992 | Beardsley |
| 5,158,347 | A | * | 10/1992 | Warren et al. ..... 312/319.8 |
| 5,172,967 | A | | 12/1992 | Pipe |
| 5,206,637 | A | * | 4/1993 | Warren ..... 340/5.22 |
| 5,211,461 | A | | 5/1993 | Teufel et al. |
| 5,225,825 | A | | 7/1993 | Warren |
| 5,251,757 | A | | 10/1993 | Relyea et al. |
| 5,259,668 | A | | 11/1993 | Teufel et al. |
| 5,282,678 | A | | 2/1994 | Teufel et al. |
| 5,322,365 | A | | 6/1994 | Teufel et al. |
| 5,377,839 | A | | 1/1995 | Relyea et al. |
| 5,385,039 | A | | 1/1995 | Feldpausch et al. |
| 5,389,919 | A | * | 2/1995 | Warren et al. ..... 340/5.31 |
| 5,743,607 | A | | 4/1998 | Teufel et al. |
| 5,803,559 | A | | 9/1998 | Carlson et al. |
| 5,820,234 | A | | 10/1998 | Capwell et al. |
| 5,841,361 | A | | 11/1998 | Hoffman |
| 5,845,524 | A | | 12/1998 | Koehler |
| 5,905,446 | A | * | 5/1999 | Benore et al. ..... 340/5.7 |
| 6,082,544 | A | | 7/2000 | Romick |
| 6,116,067 | A | | 9/2000 | Myers et al. |
| 6,130,621 | A | | 10/2000 | Weiss |
| 6,374,649 | B1 | | 4/2002 | Holcomb et al. |

(Continued)

FOREIGN PATENT DOCUMENTS

| | | |
|---|---|---|
| GB | 2 220 026 | 12/1989 |

*Primary Examiner*—Suzanne Dino Barrett
(74) *Attorney, Agent, or Firm*—Wood, Herron & Evans, LLP

(57) ABSTRACT

A locking system for a cart having at least one drawer movable between an open position and a closed position. The locking system includes a cam that is movable between a locked position, wherein the drawer of the cart is prevented from moving between the closed and open positions, and an unlocked position, wherein the drawer is released for movement between the closed and open positions. A manually actuated lock mechanism is coupled to the cam and is operable to move the cam between the locked and unlocked positions. An electronically actuated lock mechanism cooperates with the manually actuated lock mechanism to permit automatic operation of the locking system.

15 Claims, 8 Drawing Sheets

U.S. PATENT DOCUMENTS 6,746,091 B1 * 6/2004 Friar et al. ..... 312/218

6,895,792 B1 * 5/2005 Davis ..... 70/278.3

* cited by examiner

CART LOCKING DEVICE

FIELD OF THE INVENTION

This invention pertains to carts with lockable drawers, and more particularly to a locking system for medical carts.

BACKGROUND OF THE INVENTION

Carts with lockable drawers are used for many applications. For example, a medical cart having lockable drawers is used to administer medication to patients in hospitals or other care facilities. A typical medical cart has casters located at the bottom of the cart to permit easy movement of the cart by attending nurses to various patients' rooms. The cart also has one or more drawers for storing patients' medicines. Typically, each drawer is dedicated to storing the medication for an individual patient. Because the cart is used to store medications for several patients and is movable from room to room, controlling access to the contents of the cart to prevent theft or misuse of medication, and thereby protect the patients is important. One such medical cart, as described above, is disclosed in U.S. Pat. No. 5,743,607 to Tuefel et al., which patent is commonly held by the Assignee of the present invention and hereby incorporated by reference in its entirety.

Conventional medical carts have manually actuated locks which are operable to permit users to selectively lock and unlock the drawers of the cart to thereby control access to the contents stored in the drawers. Conventional medical carts have also been provided with electronically actuated locks, whereby the drawers of the cart are unlocked in an automated fashion after a user enters an access code into a keypad located on an external portion of the cart. When medical carts have been provided with both manual and electronically actuated lock mechanisms, these mechanisms have typically been provided as separate and independent systems, each individually capable of releasing the drawers of the cart from a locked condition. Because the manual and electronically actuated systems are separate, this necessarily adds to the overall complexity and cost of the carts.

There is thus a need for a simple cart locking system which overcomes drawbacks of the prior art such as those described above.

SUMMARY OF THE INVENTION

The present invention provides a locking system for a cart wherein a manually actuated lock mechanism is integrated with an electronically actuated lock mechanism to provide a compact and efficient system for controlling access to the contents of the drawers of a cart. It is recognized that unlocking the drawers of a cart using an electronically actuated lock mechanism may be initiated, for example, when a user manually enters an access code into a keypad. Accordingly, reference to the lock mechanisms as "manually actuated" and "electronically actuated," as used herein, is intended to describe the structure or manner in which the respective lock mechanisms operate to unlock the drawers of a cart.

In an exemplary embodiment, the locking system includes a cam that is operatively coupled to a drawer of the cart to permit the drawer to be secured within the cart. The cam has a locked position wherein the drawer is prevented from being moved from the closed position to the open position, and an unlocked position wherein the drawer is released for movement from the closed position to the open position.

The locking system further includes a manually actuated lock mechanism and an electronically actuated lock mechanism. The manually actuated lock mechanism is operable to permit manual manipulation of the cam between its locked and unlocked positions. In one embodiment, the manually actuated lock mechanism comprises a lock core that is manually movable between a first position corresponding to the locked position of the cam, and a second position corresponding to the unlocked position of the cam.

The electronically actuated lock mechanism cooperates with the manually actuated lock mechanism to permit automatic operation of the locking system as desired. The electronically actuated lock mechanism may be actuated when a user enters an appropriate access code into a keypad on the cart, or may be actuated by a control system of the cart according to predetermined conditions. In an exemplary embodiment, the electronically actuated lock mechanism comprises a release member engageable with the lock core of the manually actuated lock mechanism to permit automatic movement of the lock core between its first and second positions, i.e., from the locked position toward the unlocked position, or from the unlocked position toward the locked position. In another exemplary embodiment, the electronically actuated lock mechanism comprises a drive motor coupled to the release member and configured to selectively move the release member in directions toward the respective first and second positions of the lock core.

In another aspect of the invention, a method of securing contents in a drawer of a cart having a locking system as described above, comprises selectively moving the manually actuated lock mechanism from a locked condition to an unlocked condition to release a drawer of the cart for movement between closed and open positions. In one embodiment, the method includes manually moving the manually actuated lock mechanism from the locked condition to the unlocked condition. In another embodiment, the method includes automatically moving the manually actuated lock mechanism from the locked condition to the unlocked condition.

These and other objects, advantages, and features of the invention will become more readily apparent to those of ordinary skilled in the art upon review of the following detailed description of various exemplary embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
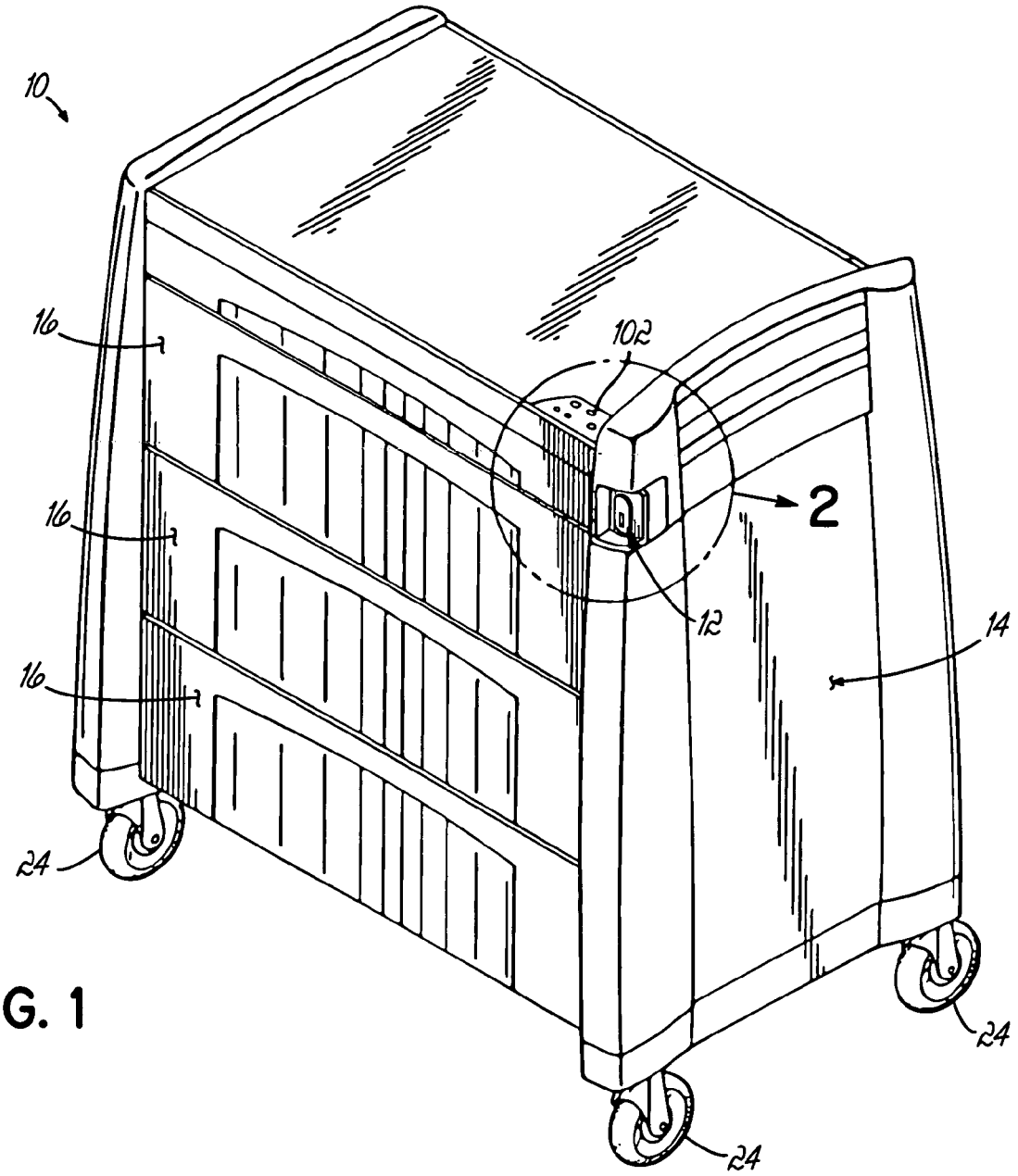
FIG. 1 is a perspective view of a medical cart including a locking system incorporating features of the present invention.
Figure 2:
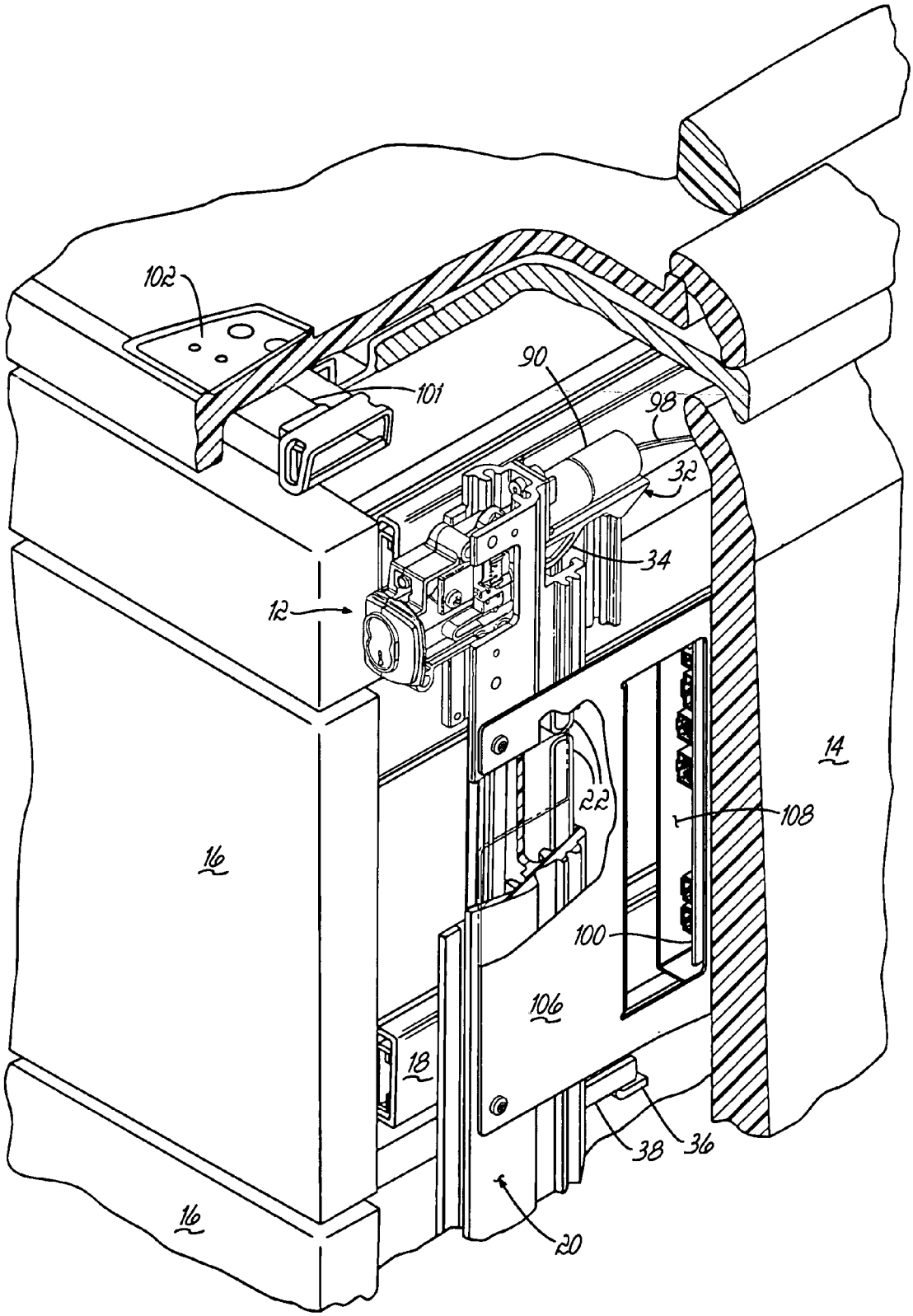
FIG. 2 is a partially broken-away perspective view showing detail of the locking system and cart of the encircled area 2 of FIG. 1.

Referring to FIGS. 1–2, a medical cart 10 including a locking system 12 incorporating features of the present invention is shown. The cart 10 has an enclosure 14 which houses a number of drawers 16, mounted on slides 18 and supported by a chassis or frame structure 20 within the enclosure 14. A series of locking tabs 22 are secured within the enclosure 14 and are supported by the frame 20 for movement to lock all of the drawers 16 in a closed position. The drawers 16 may be used, for example, to store medicines for individual patients and the cart 10 is provided with casters 24 to enable the cart 10 to be easily moved within a facility so that the cart 10 may be taken to individual patient rooms for administration of the medicines.

Figure 2A:
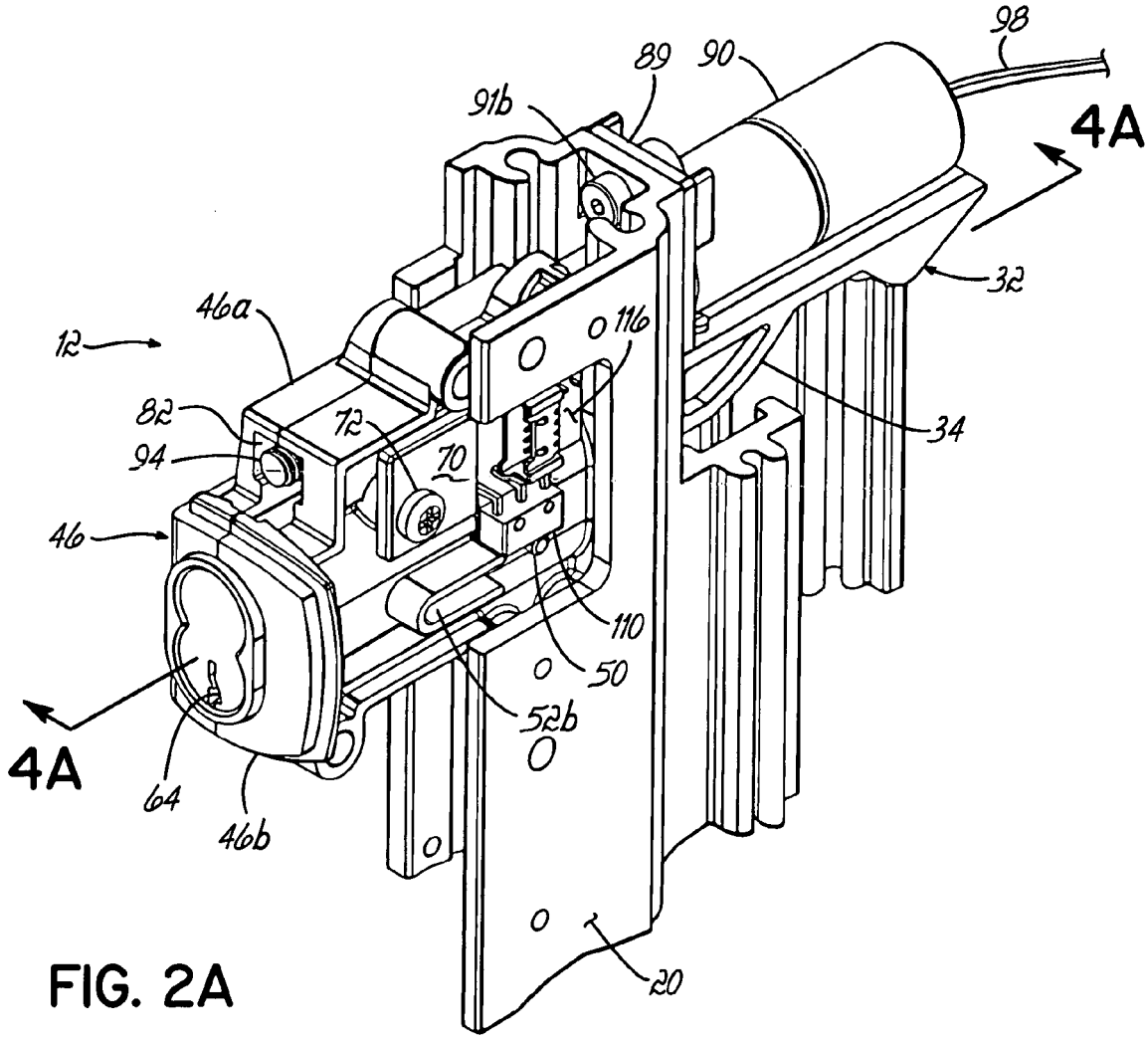
FIG. 2A is an enlarged detail view of the locking system of FIG. 2.
Figure 3:
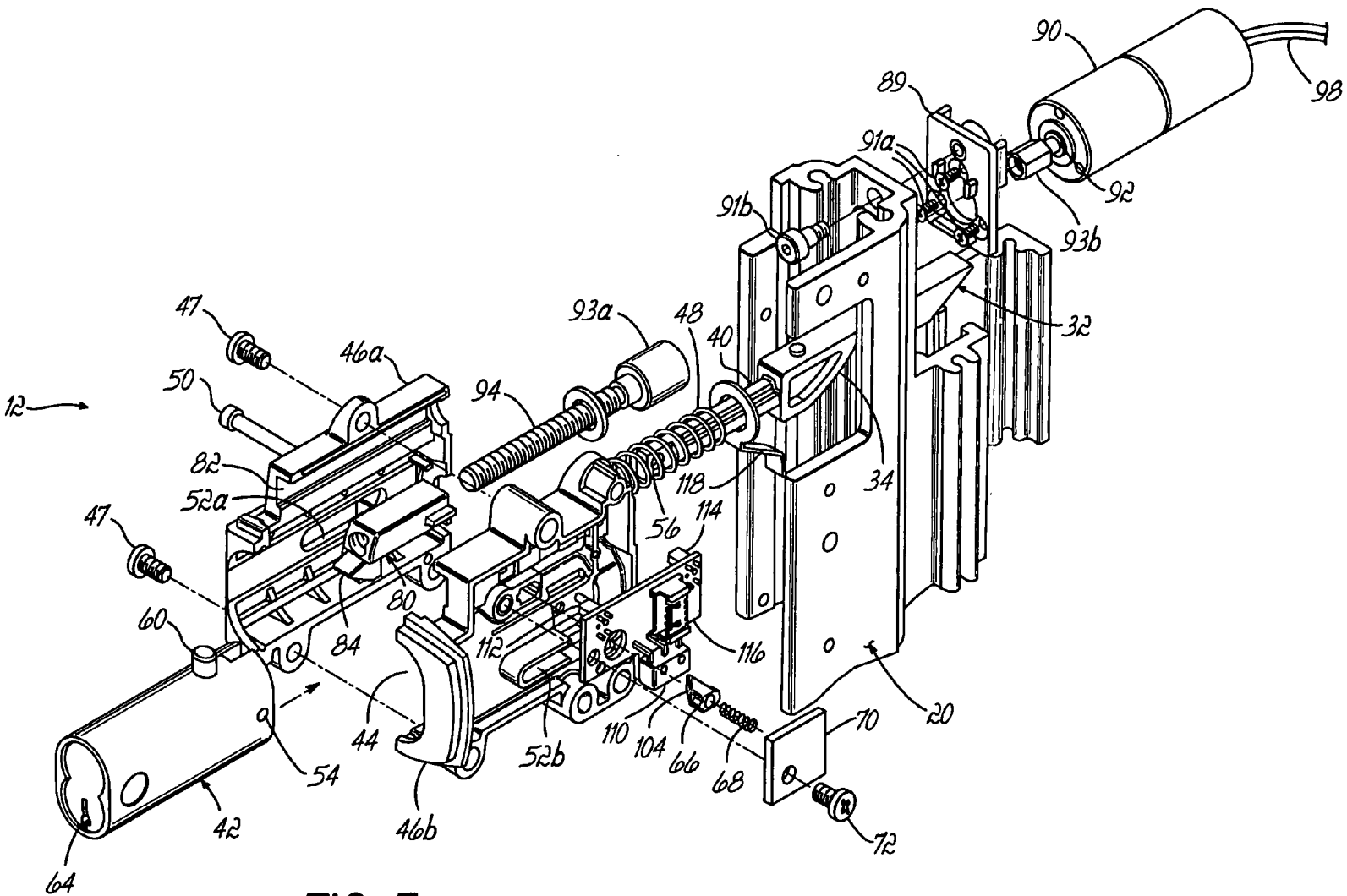
FIG. 3 is an exploded perspective view of the locking system of FIG. 2A.

Referring now to FIGS. 2, 2A and 3, the locking system 12 of the present invention includes a lock mechanism having an actuating member 32 which may be selectively engaged with the locking tabs 22 of the cart 10 to thereby move the locking tabs 22 to secure or release the drawers 16 of the cart 10. In the exemplary embodiment shown, the actuating member 32 is provided with a cam surface 34 which engages the locking tab 22. The actuating member 32 has a locked position wherein the cam surface 34 engages the locking tab 22 and moves the locking tab 22 to capture tines 36 of the drawers 16 with latches 38 coupled to the locking tab 22. The actuating member 32 may be selectively moved to an unlocked position wherein the cam surface 34 disengages the drawer locking tab 22 to release the tines 36 from the latches 38 and thereby unlock the drawers 16.

Figure 4A:
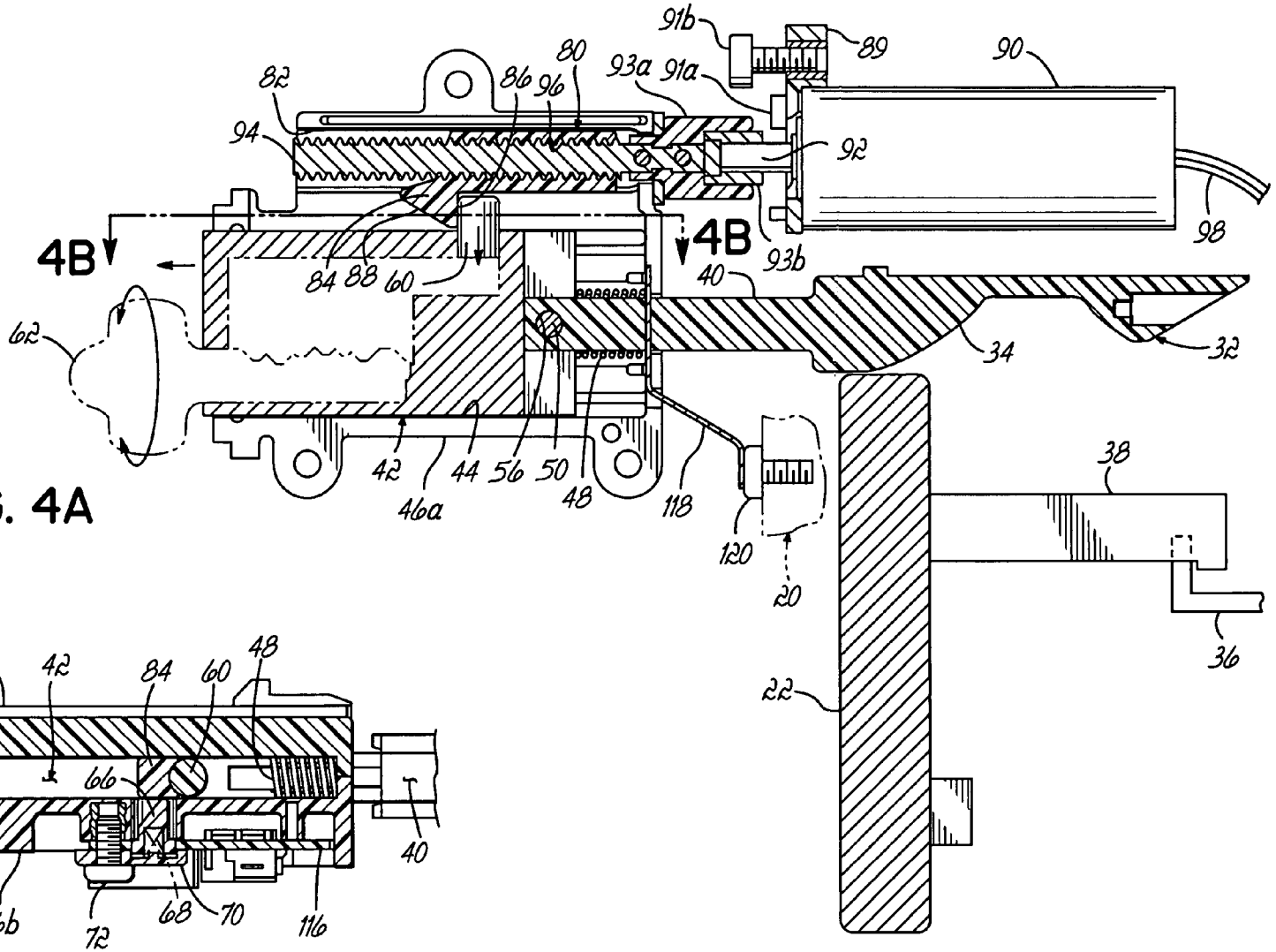
FIG. 4A is a cross-sectional view of the locking system of FIG. 2A, taken along line 4A—4A, and illustrating the locking system in a locked state.
Figure 4B:
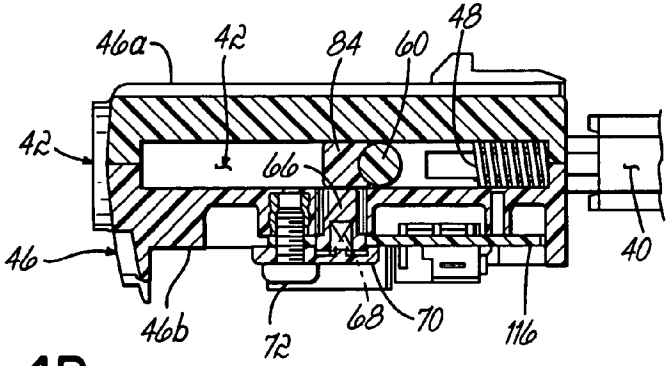
FIG. 4B is a cross-sectional view of the locking system of FIG. 4A, taken along line 4B—4B.

With continued reference to FIGS. 2 and 3, and referring further to FIGS. 4A–4B, the actuating member 32 further includes a connecting arm 40 which is coupled to a manually actuated lock mechanism of the locking system. The manually actuated lock mechanism includes a lock core 42 which is slidably received in a first channel 44 in a lock housing 46 formed by first and second housing halves 46*a*, 46*b* secured by fasteners 47, whereby movement of the lock core 42 within the lock housing 46 causes the actuating member 32 to move between the locked position (e.g. FIG. 4A) and unlocked position (e.g. FIG. 5). A spring 48 disposed between the interior of the housing 46 and the lock core 42, biases the lock core 42 in a direction toward the unlocked position of the actuating member 32. A carriage bolt 50 installed through corresponding slots 52*a*, 52*b* formed in first and second halves 46*a*, 46*b* of the housing 46 extends through holes 54, 56 formed in the lock core 42 and the connecting arm 40, respectively, to thereby couple the actuating member 32 to the lock core 42. The elongated slots 52*a*, 52*b* formed in the housing 46 also establish limits of travel for the actuating member 32 between the locked and unlocked positions.

Figure 7A:
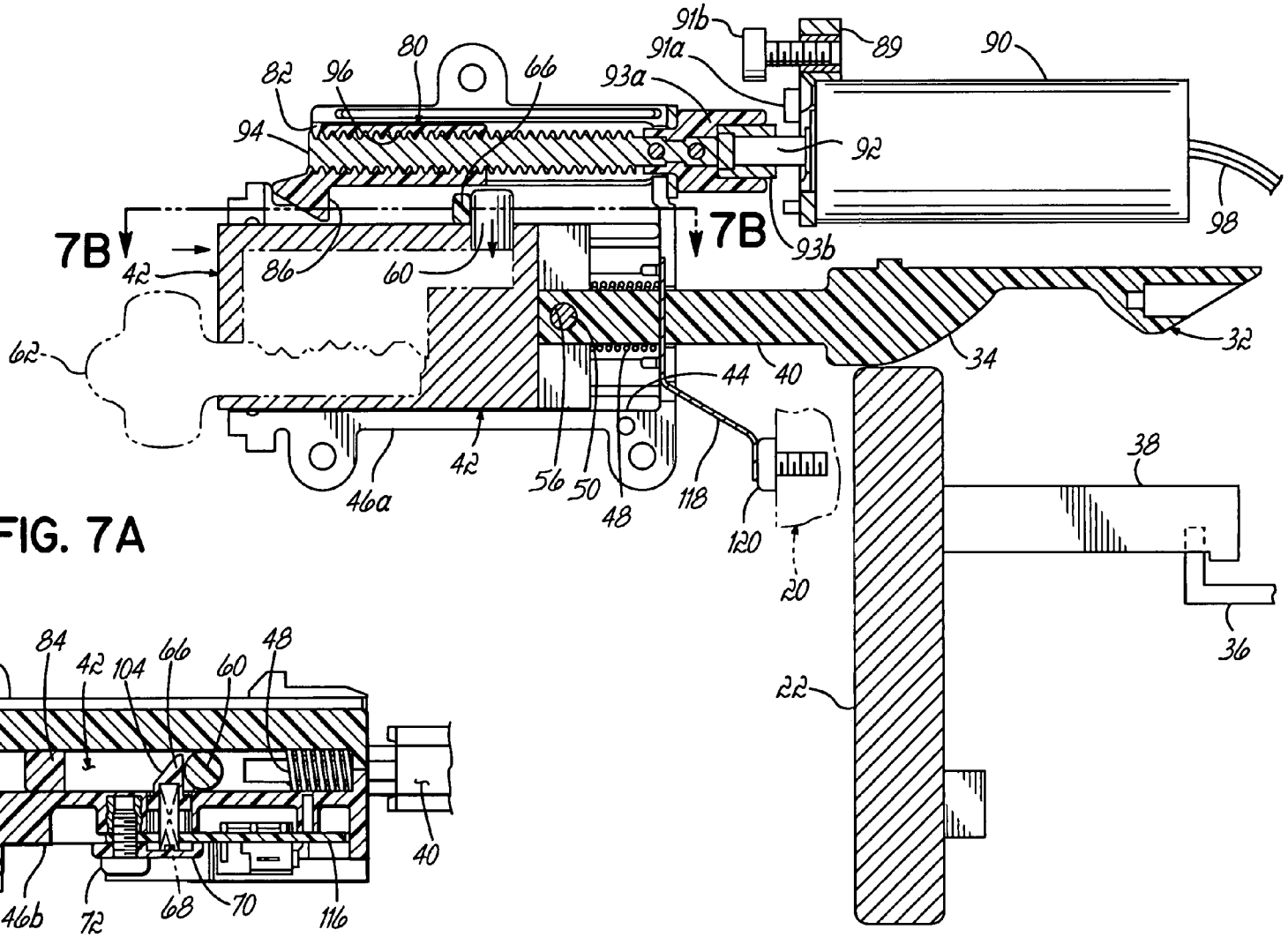
FIG. 7A is a cross-sectional view similar to FIG. 4A, illustrating the locking system in a manually locked condition after being unlocked electronically.
Figure 7B:
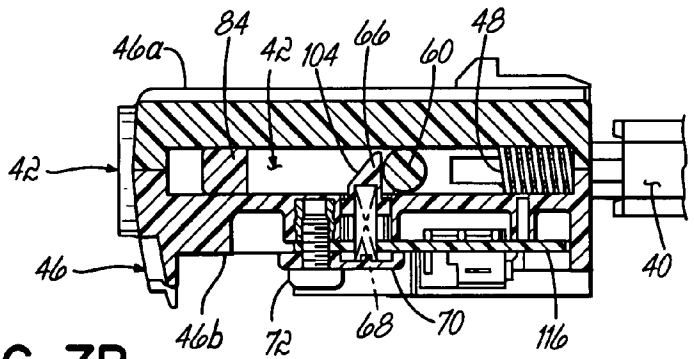
FIG. 7B is a cross-sectional view of the lock system of FIG. 7A, taken along line 7B—7B.

The lock core 42 includes a selectively retractable lock pin 60 protruding from an upper surface of the lock core 42. The lock pin 60 may be selectively caused to retract within the lock core 42 by manual manipulation of a key 62 inserted into a keyway 64 of the lock core 42. In the first, locked position of the lock core 42, the lock pin 60 engages a spring-biased lock catch 66 which protrudes into the first channel 44 (when not urged from the first channel 44 by the electronically actuated lock mechanism described below) to engage the pin 60 and thereby retain the lock core 42 in the first position as best depicted in FIGS. 7A and 7B. The lock catch 66 is biased to protrude into the first channel 44 by a second spring 68 disposed between the lock catch 66 and a retainer plate 70 secured to the housing 46 by a fastener 72. When the key 62 is inserted into the keyway 64 and manipulated to retract the lock pin 60, the lock core 42 is biased to the second, unlocked position by the first spring 48 disposed between the lock core 42 and an end wall of the housing 46. As best illustrated with reference to FIGS. 4A and 5, the first spring 48 is positioned over the connecting arm 40 and, because the actuating member 32 is coupled to the lock core 42, the first spring 48 also biases the actuating member 32 toward the unlocked position (FIGS. 7A–7B) when the lock core 42 has been released from the lock catch 66.

The locking system 12 further includes an electronically actuated lock mechanism configured to move the actuating member 32 between the locked and unlocked position without the need for a key 62 to manually operate the lock core 42. In the exemplary embodiment shown, the electronically actuated lock mechanism includes a release member 80 slidably disposed within a second channel 82 formed between the first and second housing halves 46*a*, 46*b*. The release member 80 includes a release catch 84 having a first surface 86 configured to engage the lock pin 60 to thereby prevent the lock core 42 from moving in a direction toward the second, unlocked position relative to the release member 80. A second surface 88 of the release catch 84 is inclined with respect to the lock pin 60 so that the lock pin 60 is caused to retract within the lock core 42 as the release member 80 is moved in a direction toward the second position of the lock core 42 to engage the second surface 88 of the release catch 84 with the lock pin 60.

The electronically actuated lock mechanism further includes a drive motor 90 operatively coupled t6 the release member 80 and actuable to move the release member 80 in a direction toward the second position of the lock core 42 or, alternatively, in a direction toward the first position of the lock core 42. The drive motor 90 has an output shaft 92 coupled by coupling members 93*a*, 93*b* to a lead screw 94 that extends through the second channel 82 in the housing 46 to engage the release member 80. Drive motor 90 is secured to the cart frame 20 by a mounting plate 89 and fasteners 91*a*, 91*b*. The release member 80 is formed with internal threads 96 which engage the lead screw 94 whereby rotation of the output shaft 92 in a first direction causes the release member 80 to move toward the second position of the lock core 42. Likewise, rotation of the output shaft 92 in an opposite direction causes the release member 80 to move in a direction toward the first position of the lock core 42.

The drive motor 90 is coupled by wires 98 to a power supply (not shown) and a control circuit 100 (see FIG. 2) of the medical cart 10. When a user enters an appropriate access code via a keypad 102, or other input device coupled to the control circuit 100, the control circuit 100 energizes the drive motor 90 to move the release member 80 and thereby unlock or lock the cart 10, as described more fully below. In the embodiment show in FIG. 2, control circuit 100 is supported within the enclosure 14 by a support bracket 106 secured to frame 20. A protective cover 108 may be provided on support bracket 108 to protect the control circuit 100 from moving components of the cart 10.

A secondary control circuit 101 may be provided to receive input from the keypad 102, or other user input device, and to communicate with control circuit 100 when a valid access code has been entered. While the user input device has been shown and described herein as a keypad 102 for entering an access code, it will be recognized that the input device may alternatively be a barcode scanner, a magnetic stripe reader, a device for verifying a bio-identification metric, or any other device suitable for receiving an input parameter and limiting access to the cart 10.

Referring now to FIGS. 4A, 4B, 5, 6A, 6B and 7A–7B, operation of the locking system 12 to selectively lock and unlock the drawers 16 of the medical cart 10 will now be described. FIGS. 4A–4B depict a locked condition of the cart 10 wherein the lock core 42 is in the first, locked position and the actuating member 32 is in the first position such that the cam surface 34 of the actuating member 32 engages the drawer tab 22 to cause the latch 38 on the drawer tab 22 to engage the tines 36 on the drawers 16 and thereby prevent opening of the drawers 16.

In the exemplary embodiment depicted in FIGS. 4A–4B, the release member 80 is shown at its greatest extent of travel in the direction toward the first position of the lock core 42 such that the release catch 84 of the release member 80 engages the lock pin 60 and prevents movement of the lock core 42 toward the second, unlocked position. When the release member 80 is in this position, the release member 80 also displaces the spring-biased lock catch 66 and prevents the lock catch 66 from protruding into the first channel 44 of the housing 46. Accordingly, the lock catch 66 normally protrudes into the first channel 44 of the housing 46 to engage the lock pin 60 when the lock core 42 is in the first position, as best depicted in FIGS. 7A–7B, but is displaced by the release member 80 to disengage the lock pin 60 and thereby permit the electronically actuated lock mechanism to move the lock core 42 between the first and second positions when the electronically actuated lock mechanism is actuated to lock and unlock the drawers 16 of the cart 10, as will be described more fully below.

Figure 5:
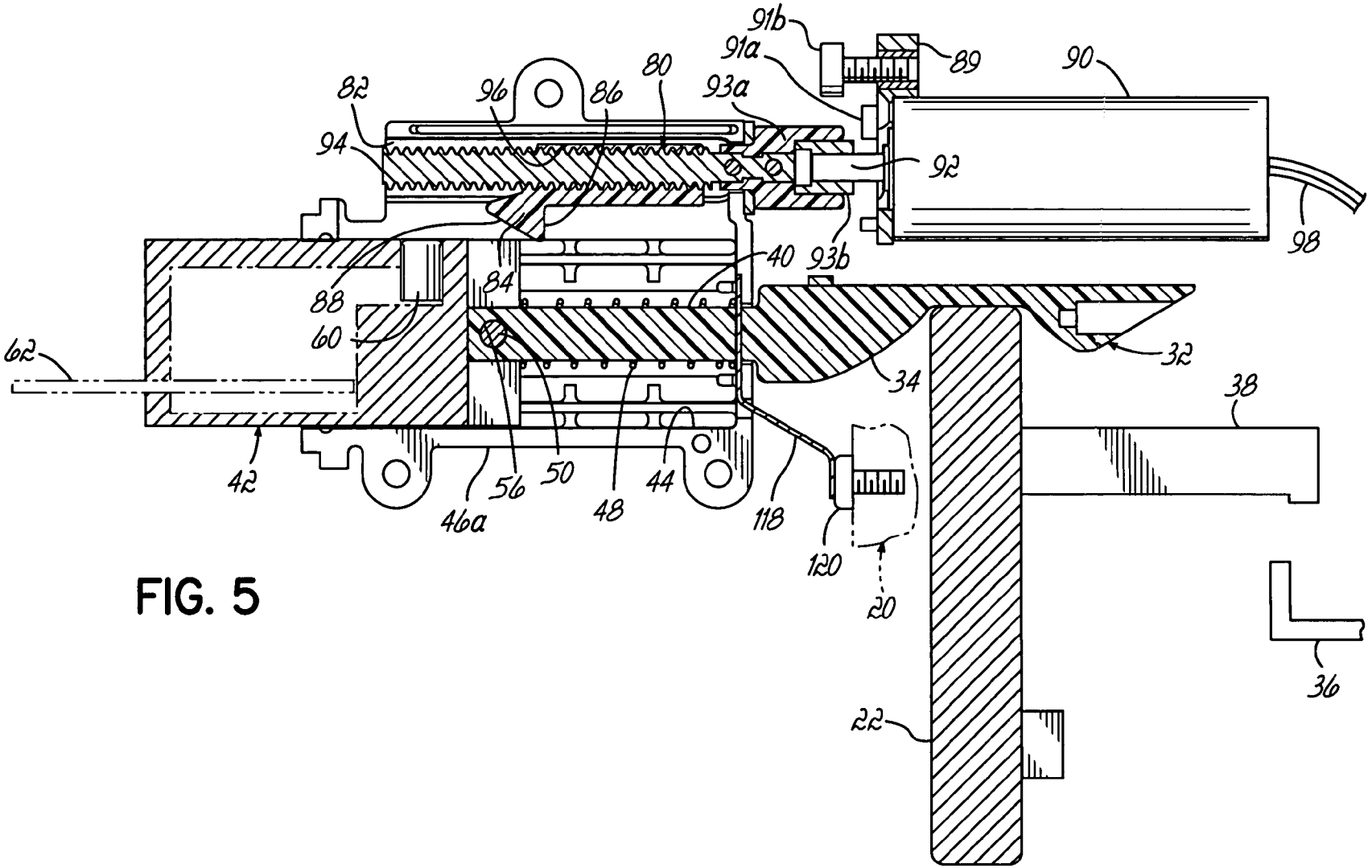
FIG. 5 is a cross-sectional view, similar to FIG. 4A, depicting the locking system manipulated to an unlocked state using a key.

To manually unlock the drawers 16 of the cart 10, the access key 62 is inserted into the keyway 64 of the lock core 42 and is actuated by rotating the key 62 to retract the lock pin 60 within the lock core 42 as best depicted with reference to FIGS. 4A and 5. After the lock pin 60 is retracted into the lock core 42, the lock core 42 is biased by the first spring 48 toward the second, unlocked position as depicted in FIG. 5. As the lock core 42 moves toward the second position, the actuating member 32 moves toward the unlocked position whereby the cam surface 34 disengages the drawer tab 22 and the drawer tab 22 moves in an upward direction so that the latch 38 releases the drawer tine 36 thereby permitting the drawers 16 of the cart 10 to be freely opened.

When it is desired to subsequently lock the drawers 16 of the cart 10 after manually unlocking them, the lock core 42 may be moved from the second position to the first position by manually pushing the lock core 42 into the housing 46 to thereby engage the lock pin 60 with the release catch 84 in the first, locked position. The lock pin 60 is displaced by the sloped, second surface 88 of the release catch 84 as the lock core 42 is moved from the second position to the first position. After the lock pin 60 has passed the first surface 86 of the release catch 84, the lock pin 60 snaps back into the extended position whereby the first surface 86 of the release catch 84 engages the lock pin 60 and prevents movement of the lock core 42 from the first position toward the second position.

Figure 6A:
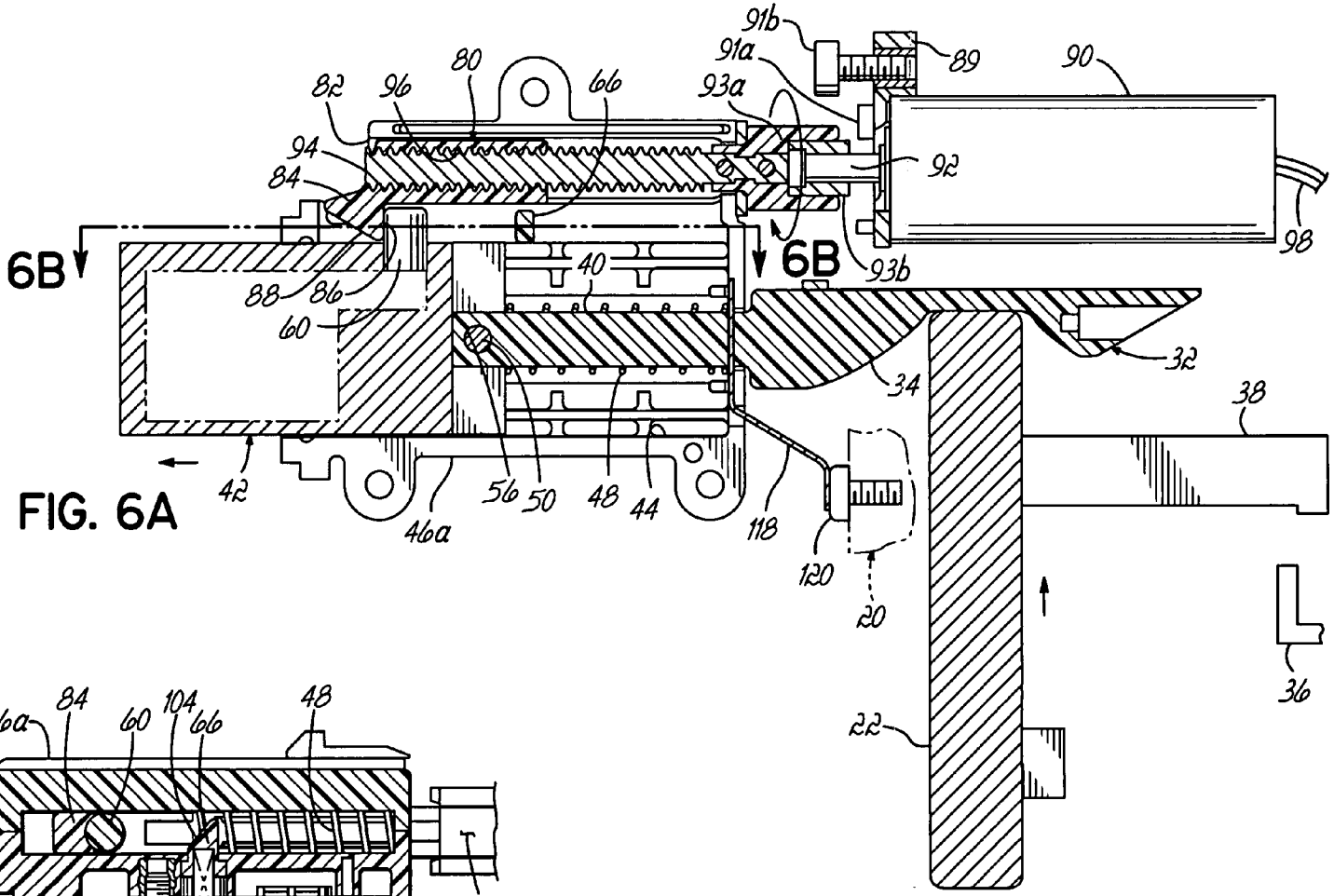
FIG. 6A is a cross-sectional view similar to FIG. 4A, illustrating the locking system in an electronically unlocked state.
Figure 6B:
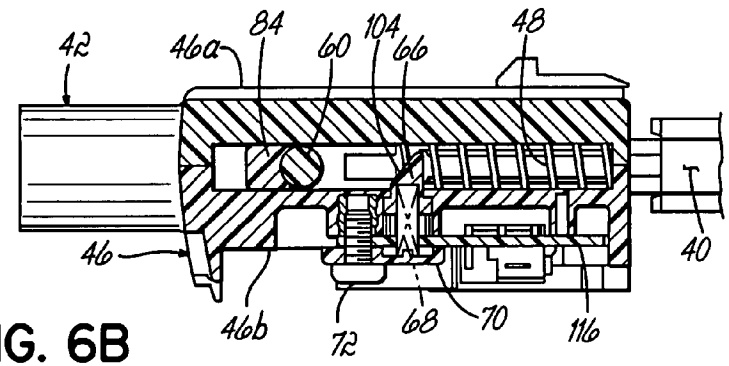
FIG. 6B is a cross-sectional view of the lock system of FIG. 6A, taken along line 6B—6B.

Alternatively, the locking system 12 of the cart 10 may be operated by utilizing the electronically actuated lock mechanism. Operation of the locking system 12 in this mode may be advantageous, for example, when the key 62 for the locking system 12 is unavailable. With reference to FIGS. 4A–4B and 6A–6B, the drawers 16 of the cart 10 may be unlocked when a user enters an appropriate access code into the keypad 102, or other user input device, as described above. After the appropriate access code has been entered, and when the release member 80 is in the position depicted in FIGS. 4A–4B, the drive motor 90 is energized to cause the release member 80 to move in a direction toward the second position of the lock core 42. Because the release member 80 displaces the lock catch 66, as described above, the lock core 42 is biased by the first spring 48 to move with the release member 80 toward the second, unlocked position, as depicted in FIGS. 6A–6B.

When it is desired to re-lock the drawers 16 of the cart 10, or when the control circuit 100 otherwise determines that the drawers 16 of the cart 10 should be locked, the drive motor 90 is energized to rotate the lead screw 94 in a direction to move the release member 80 in a direction toward the first position of the lock core 42 whereby the release catch 84 engaged with the lock pin 60 causes the lock core 42 to move from the second, unlocked position to the first, locked position, as depicted in FIGS. 4A–4B.

Alternatively, after the locking system 12 has been unlocked electronically, and is in the position illustrated in FIG. 6A–6B, the locking system 12 may be manually locked by manual displacement of the lock core 42 from the second position toward the first position. When the locking system 12 is operated in this manner to manually lock the cart 10 after being unlocked electronically, the lock pin 60 engages the lock catch 66 in the first position as depicted in FIGS. 7A–7B while the release member 80 remains in a position extended in a direction toward the second position of the lock core 42. The lock pin 60 engages a sloped surface 104 on the lock catch 66 to thereby cause the lock catch 66 to retract from the first channel 48 and allow the lock core 42 to be moved to the first position. When the lock core 42 is in the first position, the lock catch 66 is biased back into the first channel 48 of the housing 46 by the second spring 68 to thereby engage the lock pin 60 and prevent movement of the lock core 42 from the first position toward the second position.

When the medical cart 10 has been locked manually after having been unlocked electronically, as described above and depicted in FIGS. 7A–7B, and it is subsequently desired to unlock the cart 10 electronically, it will be recognized that the control circuit 100 must first energize the drive motor 90 to cause the release member 80 to move in a direction toward the first, locked position of the lock core 42 to thereby disengage the lock catch 66. In an exemplary embodiment, control circuit 100 will automatically cause the release member 80 to return to the first, locked position of the lock core 42 when the cart is manually locked after having been unlocked electronically. Subsequently, the control circuit 100 is energized the drive motor 90 to cause the release member 80 to move in a direction toward the second, unlocked position of the lock core 42, as described above with respect to FIGS. 4A–4B and 6A–6B.

The locking system 12 of the present invention may therefore be operated to lock and unlock the drawers 16 of the medical cart 10 either electronically or manually as described above. Advantageously, the locking system 12 of the present invention permits users to selectively lock or unlock the drawers 16 of the cart 10 manually or electronically, regardless of whether the drawers 16 have been previously locked or unlocked either manually or electronically. To facilitate the proper operation of the cart 10, the locking system 12 further includes sensors configured to detect the various conditions of the locking system 12. In the exemplary embodiment shown, the locking system 12 includes a first sensor 110 to detect whether the lock core 42 is in the first, locked position. In this embodiment, the first sensor 110 comprises a switch that is actuated by the carriage bolt 50 that couples the actuating member 32 to the lock core 42 and which extends through the slots 52*a*, 52*b* formed in the first and second housing halves 46*a*, 46*b*.

In another embodiment, the locking system 12 further includes second and third sensors 112, 114 configured to determine when the release member 80 has reached desired limits of travel in both the direction toward the first position of the lock core 42 and in the direction toward the second position of the lock core 42. In the exemplary embodiment shown, the second and third sensors 112, 114 comprise optical sensors positioned within the housing 46 to detect when the release member 80 has reached the respective limits of travel. The first, second, and third sensors 110, 112, 114 are mounted to a circuit board 116 and communicate with the control circuit 100. A conductive member 118 is attached to the housing 46 and is operatively coupled to the cart frame 20, such as by contact with a fastener 120, to dissipate static electricity from the housing 46 and thereby protect sensors 110, 112, 114 and circuit board 116.

The sensors 110, 112, 114 provide signals to the control circuit 100 which are used by the control circuit 100 to determine when the drive motor 90 should be de-energized to stop the release member 80 at the respective limits of travel, and to determine when the release member 80 must be moved toward the first position to disengage the lock catch 66 and thereby unlock the system 12 electronically subsequent to manual locking of the system 12, as described above.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A locking system for a cart having at least one drawer movable between an open position and a closed position, the locking system comprising:

a cam operatively coupled to the drawer and having an unlocked position wherein the drawer is movable between the open position and the closed position, and having a locked position wherein the drawer is not moveable from the closed position;

a manually actuated lock mechanism operable to permit manual manipulation of said cam between said locked position and said unlocked position; and an electronically actuated lock mechanism cooperating with said manually actuated lock mechanism to automatically move said cam between said locked position and said unlocked position;

wherein said manually actuated lock mechanism comprises:

a lock core coupled to said cam and configured for manual manipulation between a first position corresponding to said locked position of said cam, and a second position corresponding to said unlocked position of said cam, and a lock catch having an engaged condition wherein said lock core is secured against movement from said first position to said second position, and a disengaged condition wherein said lock core is moveable between said first position and said second position.

2. The locking system of claim 1, wherein said lock core is biased in a direction toward said second position.

3. The locking system of claim 1, wherein said lock core comprises a lock pin engageable with said lock catch when said lock core is in said first position, said lock pin actuable to selectively disengage said lock catch.

4. The locking system of claim 1, wherein said electronically actuated lock mechanism comprises:

a release member operable to move said lock catch from said engaged condition to said disengaged condition, and to move said lock core between said first position and said second position.

5. The locking system of claim 4, wherein said electronically actuated lock mechanism further comprises a drive motor operatively coupled to said release member and configured to move said release member in a direction toward said second position of said lock core to thereby move said cam to said unlocked position, and to move said release member in a direction toward said first position of said lock core to thereby move said cam to said locked position.

6. A locking system for a cart having at least one drawer moveable between an open position and a closed position, the locking system comprising:

a cam operatively coupled to the drawer and having an unlocked position wherein the drawer is movable between the open position and the closed position, and having a locked position wherein the drawer is not moveable from the closed position;

a manually actuated lock mechanism operable to permit manual manipulation of said cam, selectively, from said locked position toward said unlocked position, and from said unlocked position toward said locked position; and an electronically actuated lock mechanism cooperating with said manually actuated lock mechanism to automatically move said cam selectively from said locked position toward said unlocked position, and from said unlocked position toward said locked position.

7. The locking system of claim 6, further comprising at least one sensor configured to detect when said cam is in said locked position.

8. The locking system of claim 6, wherein said electronically actuated lock mechanism further comprises an input device for receiving an input parameter, and wherein said electronically actuated lock mechanism moves said cam from said locked position to said unlocked position when said input parameter corresponds to a parameter for allowing access to the cart.

9. The locking system of claim 8, wherein said input device is a keypad for receiving an input code, and said electronically actuated lock mechanism moves said cam from said locked position to said unlocked position when said input code corresponds to a stored value.

10. A lockable cart, comprising:

a cart chassis;

at least one drawer supported on said cart chassis and moveable between an open position and a closed position;

a cam operatively coupled to said drawer and having an unlocked position wherein said drawer is movable between said closed position and said open position, and having a locked position wherein said drawer is not movable from said closed position;

a manually actuated lock mechanism operable to permit manual manipulation of said cam between said locked position and said unlocked position; and an electronically actuated lock mechanism cooperating with said manually actuated lock mechanism to automatically move said cam between said locked position and said unlocked position, and to automatically move said cam between said unlocked position and said locked position.

11. A method of operating a lockable drawer of a cart, wherein the drawer is movable between an open position and a closed position, the method comprising:

selectively operating a manually actuated lock mechanism coupled to the drawer and movable between a locked condition wherein the drawer is prevented from being moved from the closed position to the open position, and an unlocked condition wherein the drawer is released for movement between the closed position and the open position, and selectively operating an electronically actuated lock mechanism coupled to the drawer and cooperating with the manually actuated lock mechanism to automatically move the manually actuated lock mechanism between the locked condition and the unlocked condition, and to automatically move the manually actuated lock mechanism between the unlocked condition and the locked condition.

12. The method of claim 11, wherein selectively operating the manually actuated lock mechanism further comprises manually manipulating the manually actuated lock mechanism.

13. The method of claim 11, wherein selectively operating the manually actuated lock mechanism further comprises actuating the electronically actuated lock mechanism to move the manually actuated lock mechanism from the unlocked condition to the locked condition.

14. The method of claim 12, further comprising operating the electronically actuated lock mechanism to move the manually actuated lock mechanism from the unlocked condition to the locked condition.

15. The method of claim 13, further comprising manually moving the manually actuated lock mechanism from the unlocked condition to the locked condition.

* * * * *

UNITED STATES PATENT AND TRADEMARK OFFICE

CERTIFICATE OF CORRECTION

PATENT NO. : 7,152,441 B2
APPLICATION NO. : 10/798634
DATED : March 11, 2004
INVENTOR(S) : Friar et al.

It is certified that error appears in the above-identified patent and that said Letters Patent is hereby corrected as shown below:

Col. 4, line 45, reads "...coupled t6 the release member 80 and..." and should read -- ...coupled to the release member 80 and... -- .

Col. 6, line 64, reads "...is energized the drive motor 90 to cause..." and should read -- ...is energized by the drive motor 90 to cause... -- .

Col. 7, line 63, Claim 1, reads "...moveable from the closed position;..." and should read -- ...movable from the closed position;... -- .

Col. 8, line 15, Claim 1, reads "...is moveable between said..." and should read -- ...is movable between said... -- .

Col. 8, line 20, Claim 3, reads "...a lock pin engageable with said..." and should read -- ...a lock pin engagable with said... -- .

Col. 8, lines 39 and 45, Claim 6, reads "...moveable..." and should read

-- ...movable... -- .

UNITED STATES PATENT AND TRADEMARK OFFICE

CERTIFICATE OF CORRECTION

PATENT NO. : 7,152,441 B2
APPLICATION NO. : 10/798634
DATED : March 11, 2004
INVENTOR(S) : Friar et al.

It is certified that error appears in the above-identified patent and that said Letters Patent is hereby corrected as shown below:

Col. 9, line 7, Claim 10, reads "...moveable between..." and should read -- ...movable between... -- .

Signed and Sealed this

Third Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,152,441 B2
APPLICATION NO. : 10/798634
DATED : December 26, 2006
INVENTOR(S) : Friar et al.

It is certified that error appears in the above-identified patent and that said Letters Patent is hereby corrected as shown below:

Col. 4, line 45, reads "...coupled t6 the release member 80 and..." and should read -- ...coupled to the release member 80 and... -- .

Col. 6, line 64, reads "...is energized the drive motor 90 to cause..." and should read -- ...is energized by the drive motor 90 to cause... -- .

Col. 7, line 63, Claim 1, reads "...moveable from the closed position;..." and should read -- ...movable from the closed position;... -- .

Col. 8, line 15, Claim 1, reads "...is moveable between said..." and should read -- ...is movable between said... -- .

Col. 8, line 20, Claim 3, reads "...a lock pin engageable with said..." and should read -- ...a lock pin engagable with said... -- .

Col. 8, lines 39 and 45, Claim 6, reads "...moveable..." and should read

-- ...movable... -- .

UNITED STATES PATENT AND TRADEMARK OFFICE

CERTIFICATE OF CORRECTION

PATENT NO. : 7,152,441 B2
APPLICATION NO. : 10/798634
DATED : December 26, 2006
INVENTOR(S) : Friar et al.

It is certified that error appears in the above-identified patent and that said Letters Patent is hereby corrected as shown below:

Col. 9, line 7, Claim 10, reads "...moveable between..." and should read -- ...movable between... -- .

This certificate supersedes Certificate of Correction issued April 3, 2007.

Signed and Sealed this

Eighth Day of May, 2007

JON W. DUDAS
*Director of the United States Patent and Trademark Office*